US005628582A

United States Patent [19]

Nagle

[11] Patent Number: 5,628,582

[45] Date of Patent: May 13, 1997

[54] CONCRETE BARRIER ERECTION AND ALIGNMENT SYSTEM

[75] Inventor: Gordon A. Nagle, West Brunswick Township, Schuylkill County, Pa.

[73] Assignee: Schuylkill Products, Inc., Cressona, Pa.

[21] Appl. No.: 427,156

[22] Filed: Apr. 24, 1995

[51] Int. Cl.[6] ..... E01F 13/02

[52] U.S. Cl. ..... 404/6; 404/7; 52/223.7; 52/747.12; 14/77.1

[58] Field of Search ..... 404/6, 7, 9–14, 404/72, 73, 37, 40, 64; 256/13.1, 1, 19; 52/223.7, 223.11, 747.12, 745.05, 745.08, 745.1, 745.14; 264/261; 14/73, 73.1, 73.5, 77.1

[56] References Cited

U.S. PATENT DOCUMENTS

| | | | |
|---|---|---|---|
| 3,094,907 | 6/1963 | Hirst | 404/40 |
| 3,326,099 | 6/1967 | Cova et al. | 404/13 X |
| 3,555,753 | 1/1971 | Magadini | 52/747.12 X |
| 3,559,361 | 2/1971 | Sarros | 52/223.7 X |
| 3,732,653 | 5/1973 | Pickett . | |
| 3,788,023 | 1/1974 | Macchi | 52/223.11 X |
| 3,863,417 | 2/1975 | Franchi | 52/745.05 |
| 3,892,096 | 7/1975 | Macchi | 52/223.11 |
| 4,001,988 | 1/1977 | Riefler | 52/223.7 X |
| 4,442,149 | 4/1984 | Bennett | 52/223.7 X |
| 4,509,305 | 4/1985 | Guinard | 52/223 R |
| 4,605,336 | 8/1986 | Slaw . | |
| 4,629,357 | 12/1986 | Wattenburg et al. | 404/13 X |
| 4,642,964 | 2/1987 | Kellison . | |
| 4,666,332 | 5/1987 | Burgett | 404/6 |
| 4,726,567 | 2/1988 | Greenberg | 52/223.7 X |
| 4,848,058 | 7/1989 | Mullen | 404/40 X |
| 4,932,178 | 6/1990 | Mozingo | 52/223.7 |
| 4,954,009 | 9/1990 | Kellison . | |
| 5,007,763 | 4/1991 | Burgett | 404/9 X |
| 5,118,542 | 6/1992 | McLeod | 404/37 X |
| 5,131,786 | 7/1992 | House . | |
| 5,134,817 | 8/1992 | Richardt | 404/7 X |
| 5,218,805 | 6/1993 | Rex . | |

OTHER PUBLICATIONS

Precast Concrete by Kurt Billig, pp. 171–174, D. Van Nostrand Company, Inc. New York, 1955.

*Primary Examiner*—James A. Lisehora
*Attorney, Agent, or Firm*—Daniel A. Sullivan, Jr.

[57] ABSTRACT

Concrete barriers are on a prestressing strand running through the barriers. The prestressing strand may serve to move the barriers together to compact a pliable joint material between the barriers. Following joint compaction, the barriers may be held in place by anchoring to a foundation.

24 Claims, 6 Drawing Sheets

CONCRETE BARRIER ERECTION AND ALIGNMENT SYSTEM

TECHNICAL FIELD

The present invention relates to methods for emplacing concrete barriers and to structures formed of concrete barriers.

BACKGROUND OF INVENTION

U.S. Pat. No. 4,954,009 shows in its FIG. 5 a prestressed concrete barrier extension member 100 which spans a joint between two adjacent barriers 20. The structure is said to resist the exposing of an end face of a barrier directly to a vehicle impinging a first of the pair of adjacent barriers.

DISCLOSURE OF INVENTION

Objects of the invention include the provision of a new method for the erection and alignment of concrete barriers and a new structure formed of concrete barriers.

Other objects of the invention will become apparent from the remainder of this specification as set forth below.

Concrete barriers, made, for instance, of Portland cement and suitable aggregate, are used for many purposes, particularly for the purpose of separating or restraining vehicular traffic. The provision of these barriers as precast shapes is particularly advantageous, because it permits them to be manufactured in high quantity and quality in plants especially equipped for such purpose. While this invention is especially suited for use with precast concrete barriers, it is also useful for machine-formed and cast-in-place barriers. "Machine formed" refers to a process of manufacturing concrete barriers by extrusion from a moving mold; the process is also referred to as slipforming.

An example of the use of concrete barriers is as median barriers on a highway, for a principal purpose of reducing the danger of head-on collisions. Another example is as bridge parapets, to provide resistance against sideways deviation from bridges.

The present invention will be illustrated below using bridge parapets as an example. Its application to median and other barriers will be readily apparent to those skilled in the art on the basis of the parapet illustration.

An important characteristic of the invention is the stringing of concrete barriers on cable, for instance a prestressing strand, in the manner of beads on a wire. Another important characteristic in a further development of the invention is the use of cable to compact joint material between adjoining barriers. Yet another advantageous characteristic in another development of the invention is the locking of prestress into a prestressing strand, by the securing of the barriers to a foundation, such as a bridge deck, by anchor fasteners, following compacting of the joint material; the prestress is not lost even if some creep occurs in the joint material over time. Other important characteristics of the invention will become apparent in the remaining explanations below.

BRIEF DESCRIPTION OF THE DRAWINGS

In the Figures, like features bear the same numerals.

MODES OF THE INVENTION

Figure 1:
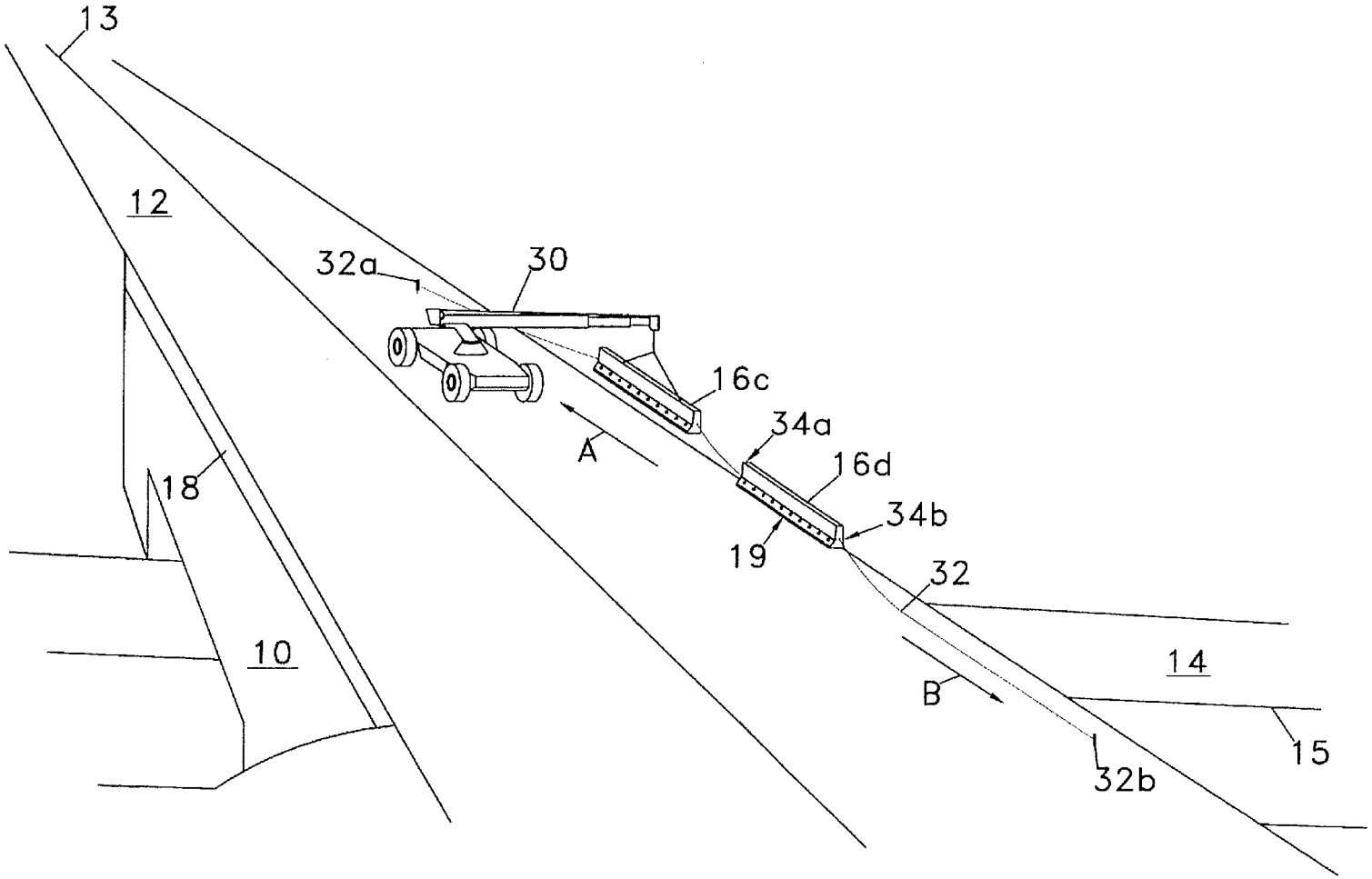
FIG. 1 is a perspective view of the invention as applied to forming a parapet on an overpass bridge.

FIG. 1 shows a concrete bridge 10, serving as an overpass for road 12 over road 14. Lines 13 and 15 represent painted centerlines on the roads. Precast concrete parapet barriers 16*c* and 16*d* are in the process of being emplaced on the right side of bridge deck 18. Barriers 16*c* and *d* are two of a set of seven barriers 16*a*–16*g* which are to be emplaced to form a parapet spanning the right side of deck 18. The barriers may measure 20-feet in length, making the span 140-feet in this example.

Figure 2:
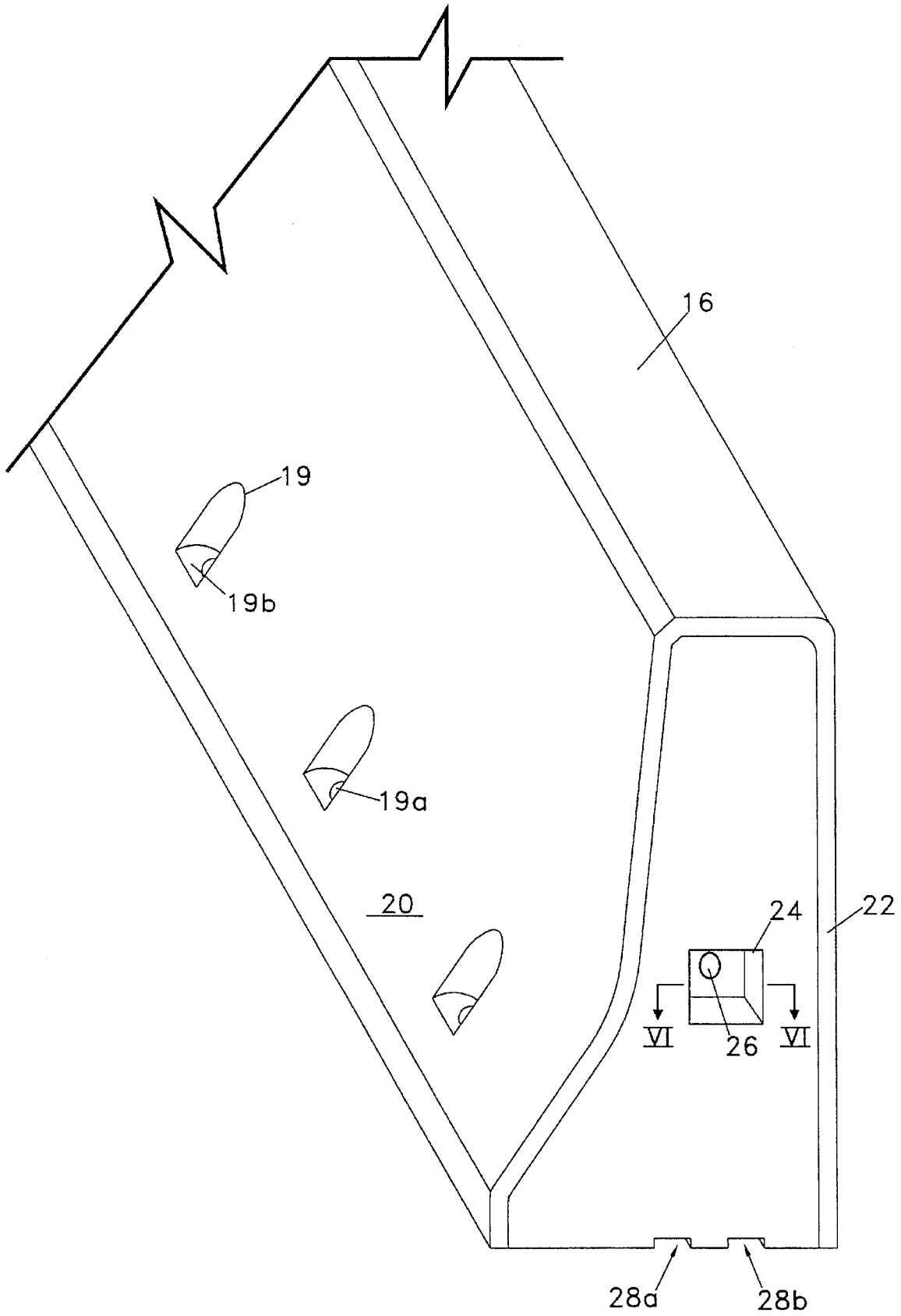
FIG. 2 is a close-up, oblique, partially cut away view of a barrier as used in FIG. 1.

FIG. 2 illustrates a typical barrier 16, to show details of barriers 16*a*–*g*. Anchor pockets 19 are provided on the shoulder 20 on the traffic side of the barrier. Each pocket 19 has a hole 19*a* extending downwards to the bottom of the barrier. In the scale of FIG. 1, the anchor pockets appear as a line of dots. Each end of the barrier (only one end is shown) has a chamfer 22 on its upper edges and an anchorage blockout, or recess, 24 at the two ends of a tube 26 which extends longitudinally from one end of the barrier to the other for later reception of a prestressing strand. As shown in FIG. 2, tube 26 is located centrally in the cross section of the barrier. Keyways 28*a* and 28*b* extend longitudinally from one end of the barrier to the other.

FIGS. 1 and 3–7 illustrate a preferred mode of the erection and alignment, or emplacement, process of the invention.

Figure 3:
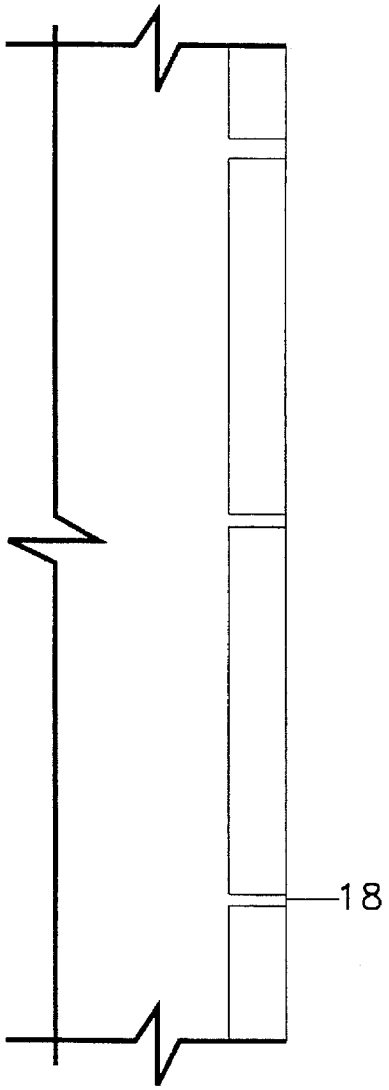
FIG. 3 is a partially cut away, plan view of the right side of the deck of the bridge of FIG. 1, showing layout before placement of the parapet-forming barriers.

In FIG. 3, a plan for barrier placement has been laid out on the bridge deck 18, showing the outline of each precast barrier, the important locations being the leading and trailing edges (also called below the ahead and back ends, respectively) of each barrier and the joints between the barriers. A preliminary layout provides a means to control the placement of the barriers and identify irregularities before placement is started. Since grout will be placed as a bed for each barrier as it is set in place, reference marks (not shown) may also be placed outside of, or offset from, the actual outlines and a gage of a selected standard length set between these reference marks and the barrier in final positioning of a barrier; the use of reference marks is a well-known measure in the concrete and masonry fields and is known by those of ordinary skill in the art to which this invention pertains.

On single span structures, such as the bridge of FIG. 1, it is preferred to start placement of the precast barriers in the middle of the span, working first from the middle to one end, then from the middle back to the other end. This preferred technique is, in fact, the one illustrated in FIG. 1. It has the advantage of reducing by half, at the span ends, the potential maximum cumulative effect of deviations within the tolerance at which one is working.

On multiple span structures, the technique of starting from the middle may not be possible, because existing sections in place may block access to the prestress strand. In this case, placement may progress from one end to the other, while taking increased care to control joint thicknesses and plan versus actual running dimensions of barrier placement.

Figure 4:
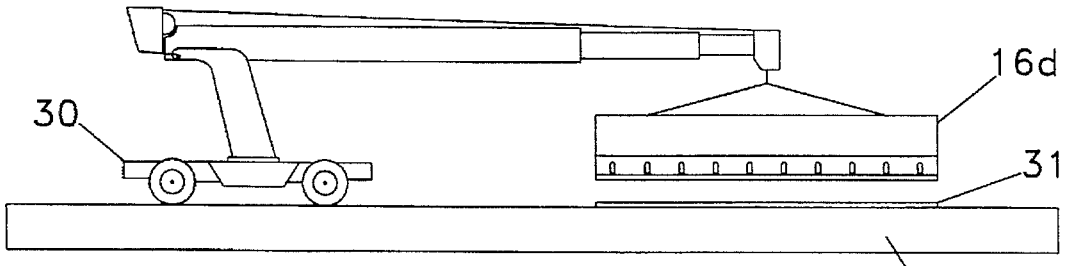
FIG. 4 is an elevational view from the left side of the bridge of FIG. 1 showing an initial precast concrete barrier being set into place on a grout bed on the right side of the bridge.

FIG. 4 shows a crane 30 lowering middle barrier 16*d* onto a grout bed 31 on bridge deck 18. The grout bed is a paste or slurry. Grout bed thickess is, for example, one-half inch. The grout serves to fill uneven area in the interface and provide an improved bond and non-rocking base for the barrier. The concrete bridge deck may have a broomed surface, which provides grooves for the grout to fill, to interlock with the bridge deck. A suitable grout mixture is sand, cement, and water in the volume ratio 3:2:1, respectively. Suitable grout mixtures can be purchased, for instance under the Permagrout label.

Barrier 16*d* is lowered onto the grout bed while the grout is still workable. Grout rises into keyways 28*a* and 28*b* (FIG. 2), whose purpose is to provide interlocking against sideways shear movement of the barrier, once the grout has cured.

Barrier 16*d* is then anchored to the bridge deck 18 through the holes 19*a* in anchor pockets 19. Any suitably secure anchor system may be used in pockets 19, an example being the anchor system 34 of the above-referenced U.S. Pat. No. 4,954,009. U.S. Pat. Nos. 4,954,009 and 4,642,964 are incorporated here by reference for details on suitable anchoring. Instead of the washer 35 of U.S. Pat. No. 4,954,009, it may be advantageous to embed in the floors 19*b* of the anchor pockets a rectangular washer plate, such as that shown in FIG. 5 of U.S. Pat. No. 5,218,805 of Rex. U.S. Pat. No. 5,218,805 is incorporated here by reference. Once a barrier is anchored, placement of subsequent sections does not disturb its location on the bridge deck.

In FIG. 1, certain process steps beyond the state shown in FIG. 4 have already been accomplished. For instance, prestressing strand 32 has been manually grasped and pushed from one end of tube 26 in barrier 16*d*, through the barrier, and out the other end. Strand 32 is, for example, one-half inch diameter prestressing strand and tube 26 is formed by one-inch diameter electrical metallic tubing.

Figure 5:
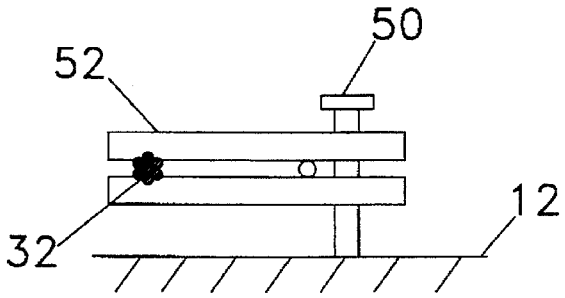
FIG. 5 is a detail, elevational, cross sectional view at strand end 32*a*, taken with a cutting plane whose normal is parallel to centerline 13 in FIG. 1, looking in the direction of arrow A in FIG. 1, showing details of a suitable strand-end securement.

Strand 32 was then drawn through barrier 16*d* to span the length of the bridge deck, following which it was releasably and temporarily secured to the roadway at its ends 32*a* and 32*b*. FIG. 5 illustrates a suitable securement, including stake 50, which is driven into the roadway 12, and a clamp 52 mounted on the stake and clamping strand 32.

Working from the initially installed barrier 16*d*, the six remaining barriers 16*a–c* and 16*e–g* are then emplaced. Two working directions are used, one for emplacement of barriers 16*a–c* and the other for emplacement of barriers 16*e–g*. That for 16*a–c* is represented by Arrow A in FIG. 1, in the direction from the middle of the bridge span at barrier 16*d* toward strand end 32*a*. Arrow B, pointing from barrier 16*d* to strand end 32*b*, is the emplacement direction for barriers 16*e–g*. Working in the direction of Arrow A, barrier 16*c* is first emplaced next to barrier 16*d*, then 16*b* next to 16*c*, and finally 16*a* next to b. Similarly for the working direction of Arrow B, the sequence is first 16*e*, then 16*f*, then 16*g*.

In FIG. 1, barrier 16*c* is shown being brought into place against barrier 16*d*. Thus, FIG. 1 shows work beginning in the direction of Arrow A. While working in any particular work direction, the end of any barrier facing in the direction of the work direction is called the "ahead" end, while the end facing counter to the work direction is called the "back" end.

Figure 6:
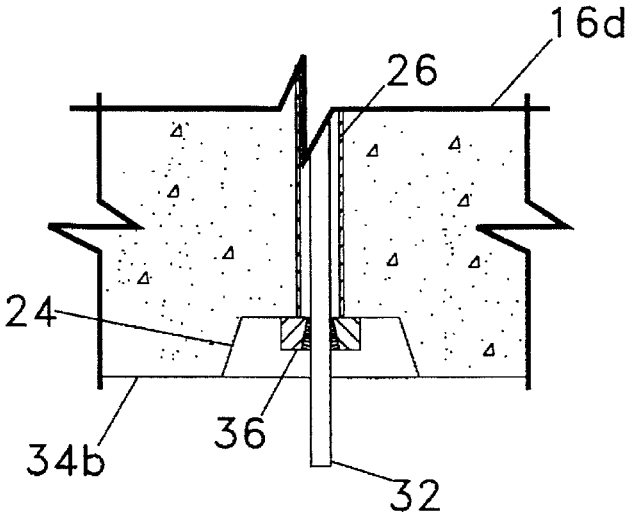
FIG. 6 is a plan, cross-sectional, partially cut away view according to cutting plane 6—6 in FIG. 2, showing supplemental structure for a particular installation involving a barrier of FIG. 2.

For working first in the direction of Arrow A, as in FIG. 1, FIG. 6 shows that a strand chuck 36 has been placed on strand 32 at the back end 34*b* of barrier 16*d*, to anchor the strand. Chuck 36 is put in place at any time after strand 32 has been adjusted relative to barrier 16*d* to span the bridge deck and before the prestressing of barrier 16*c* against barrier 16*d*. An example of a suitable strand chuck is an anchor chuck, available, for instance, from Prestress Supply Inc. of Lakeland, Fla.

To reach the state shown in FIG. 1, crane 30 started with barrier 16*c* at strand end 32*a*. There, strand end 32*a* was fed through the tube 26 in the barrier 16*c*. End 32*a* was then resecured, so that barrier 16*c* then slid on strand 32, as crane 30 moved toward barrier 16*d*, to the point shown in FIG. 1.

Alternatively, rather than to extend strand 32 fully along the bridge deck as shown, a system of coiling and uncoiling the strand can be used, as new barriers are strung on the strand. As the strand is pushed through the tube 26 of a new barrier and exits from its ahead end, it is coiled on the bridge deck. The tendency of the friction between the strand and tube 26 to drag the coil as the barrier is brought by the crane into place is resisted manually. When it is time to thread the strand through a next barrier, the coil is turned over, to expose the free end of the strand so that it can be fed from the coil through the next barrier.

It will be recognized that strand 32 may also be pieced together, using splice chucks, in order to limit the size of coil that one needs to work with. Splice chucks may also be used to create strands of any desired continuous length, so that the concepts of the invention can be applied to barrier installations extending even one or more miles. Splice chucks are available, for instance, from Prestress Supply Inc. of Lakeland, Fla.

In preparation for the joining of barrier 16*c* with barrier 16*d*, a grout bed is placed on bridge deck 18 for barrier 16*c* and the face of the ahead end 34*a* of barrier 16*d* is supplied with, for example, a one-inch layer of joint material. An example of a suitable joint material is Ceramar flexible foam expansion joint filler, a product of W.R. Meadows, Inc., of Elgin, Ill. Typical physical properties of Ceramar joint filler are provided in Table 1.

TABLE 1

| Typical Physical Properties* (½" thick test specimen) | |
|---|---|
| 1. Compression, 50% | 13.3 psi |
| 2. Extrusion | 0.1 inch |
| 3. Recovery | 99.21% |
| 4. Water Absorption, Volume % | 0.246 |

*Test Method — ASTM D-545

A shape matching the barrier end (FIG. 2) is cut from a panel of this material. The shape is provided with a cutout matching hole 24, threaded onto strand 32 and brought against barrier 16*d*. A sealant, such as the Sealtight sealants of the Meadows company, may be painted onto one or both of the barrier ends to provide stickiness to hold the flexible foam material temporarily in place until the barriers are brought together sufficiently to hold it in place with the compaction of the invention.

Figure 7:
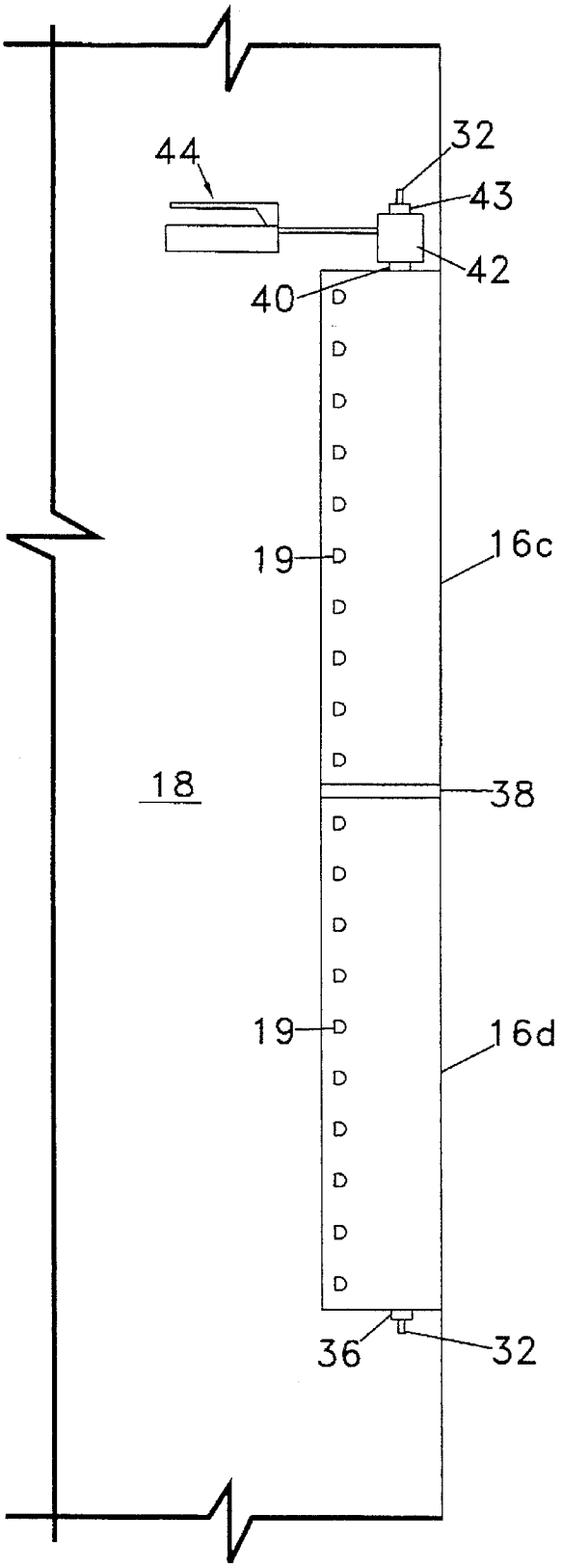
FIG. 7 is a partially cut away, top view of the right side of the bridge of FIG. 1, showing the joining of two barriers.

FIG. 7 shows barrier 16*c* just after it has been set down, by crane 30, onto its grout bed beside barrier 16*d*. Joint material 38 lies between the two barriers. Strand chuck 40 has been placed on the strand 32 in recess 24 (FIG. 2). Centerhole ram 42 sits on the strand 32 ahead of chuck 40 and is operated by hydraulic pump jack 44 to push against auxiliary strand chuck 43 to tension the prestressing strand 32 against chuck 36 at the back end of barrier 16*d*. The ram and jack may be a ram and pump combination set available from OTC Power Team Industrial Division of Owatonna Tool Company, SPX Corp., Owatonna, Minn. Joint material 38 is compressed and compacted between the barriers. When the desired joint thickness, for example ¾-inches, is reached jack 44 is released and strand chuck 40 grips the strand to prevent the two barriers from moving apart. Suitable examples for chucks 40 and 43 are multiple use strand chucks available from Prestress Supply Inc. of Lakeland, Fla.; these chucks contain a spring to keep their jaw segments aligned for correct seating.

The ¾-inch joint thickness referenced in the previous paragraph corresponds to 75% of the original thickness of the joint material. From Table 1, it is evident, from the fact that the Ceramar joint filler can be compressed to 50%, that the joint of the example permits at least another ¼-inch of joint compression. Of course, since the joint material has an original thickness of 1", the ¾-inch joint permits at least ¼-inch of joint expansion, as well. Choice of 75% compression as the initial condition of the material in the joint thus means that the joint material is initially still in a flexible state in which it is capable of accomodating either compressive or expansive movement. Not only is the Ceramar material an expansion joint filler, but it is, in fact, being used as an expansion joint in the present invention.

In general, barrier 16*c* will be found to align itself with barrier 16*d* during the strand tensioning, but adjustments may be made by pushing or pulling the ahead end of barrier 16*c* into alignment as required. Barrier 16*c* is then anchored to the bridge deck through its anchor pockets 19. Should there be any subsequent creep in the joint material, the anchoring prevents loss of the prestress level in the strand 32 achieved at the original compacting of the joint material.

An example of a maximum force needed in strand 32 is 9000 lbs., which is derived as follows. Estimated jacking force necessary to compress 3 square feet of Ceramar expansion joint filler is 6000 lbs. Estimated jacking force necessary to drag a 5-ton precast barrier at 0.30 friction factor is 3000 lbs. These two figures added together give the 9000 lbs. The compressive stress on the joint filler is 6000 lbs./3 $ft^2$=14 psi.

Figure 9:
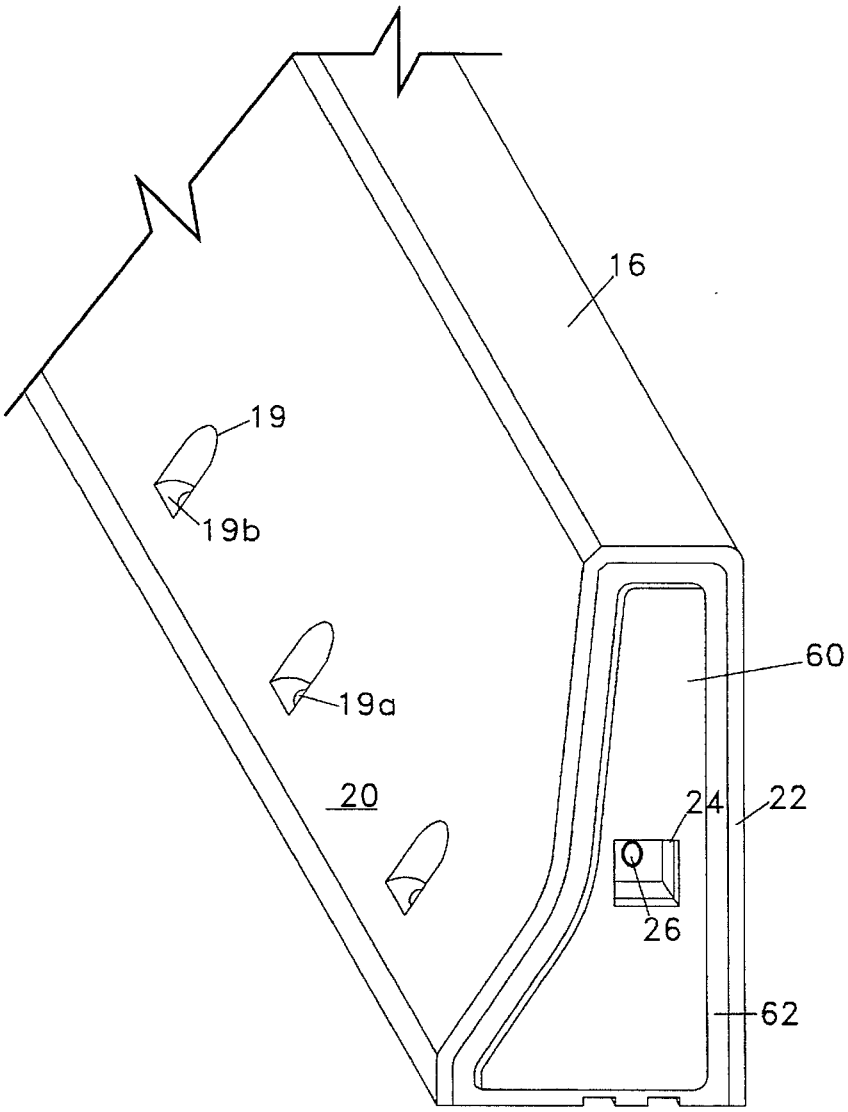
FIG. 9 is a view as in FIG. 2, of a modification of the barrier of FIG. 2.

It will thus be noted that the force in the prestressing strand is significantly less than what would be used in a typical prestressed beam application. If greater forces are desired in the prestressing strand, this can be accomplished by designing lands on one or both of the barrier ends, around recess 24, and using a continuous ring of joint material on the remaining barrier end face around the land. A material stiffer than the joint material can be placed on the land surface for accomodating thermal expansions while yet permitting greater tension in the prestressing strand. FIG. 9 is an adaptation of FIG. 2, showing a land 60 for such purpose. The ring of joint material would be on the collar face 62, which surrounds land 60.

Figure 8:
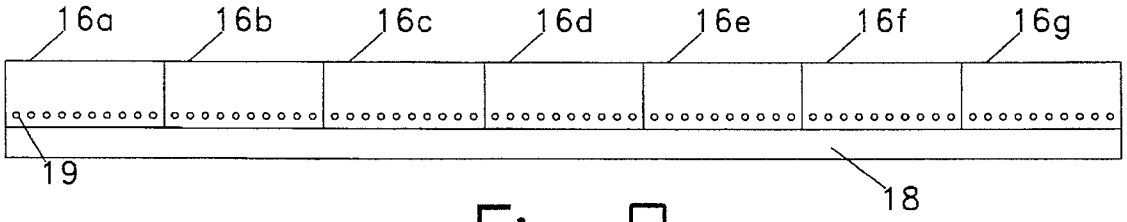
FIG. 8 is an elevational view from the left side of the bridge of FIG. 1 showing a completed assembly of seven precast concrete barriers to form a parapet on the right side of the bridge deck.

Barriers 16*b* and a are emplaced in like manner to the procedure used for barrier 16*c*, and then the other side, in the sequence 16*e*, *f* and *g*. FIG. 8 shows the finished parapet made up of seven barriers 16*a–g*. As will be appreciated by those skilled in the art, suitable termination, such as impact attenuators, would be added to the ends of the parapet before the parapet would be placed in service.

While the above-described modes of the invention relate to a precast concrete barrier, concepts of the invention can be used also in the case of machine-formed concrete barriers and cast-in-place concrete barriers. For instance, the concept of having a continuous cable extending through a plurality of barriers is useful for both machine-formed and cast-in-place barriers; if one barrier is impacted, the presence of the cable transfers the load to neighboring barriers to restrain tilting or shifting of the impacted barrier out of place. The cable may even contain prestress, to improve its tilt resisting effect. And, of course, if the machine-formed and cast-in-place barriers are not initially anchored to a foundation, then the above-described joint compacting advantage in the case of precast barriers becomes available for these other two classes of barriers as well.

The above explanations of modes of the invention are to be understood in the sense of examples. Various changes can be made without departing from the spirit and scope of the invention as defined by the claims set forth below and by the range of equivalency allowed by law.

What is claimed is:

1. A traffic barrier erection method, comprising the steps of anchoring a first precast concrete traffic barrier to a foundation, stringing a prestressing strand through the first barrier, anchoring the strand at a back end of the first barrier, placing joint material of a more pliable character than concrete at an ahead end of the first barrier, stringing the strand through a second precast concrete traffic barrier, and tensioning the strand at an ahead end of the second barrier to cause a back end of the second barrier to compact the joint material to form an expansion joint containing the compacted joint material between the back end of the second barrier and the ahead end of the first barrier.

2. A method as claimed in claim 1, the joint material being capable of accomodating further joint compression of at least about ¼-inch following the step of tensioning.

3. A method as claimed in claim 2, the joint material being capable of accomodating joint expansion of at least about ¼-inch following the step of tensioning.

4. A method as claimed in claim 1, the joint having a thickness occupied completely by material which is more pliable than that of the barriers.

5. A method for emplacing barriers, comprising the steps of stringing the barriers on a cable, placing between the barriers a joint material which is more pliable than that of the barriers, and tensioning to prestress the cable, the step of tensioning compacting the joint material to a desired expansion joint thickness, further comprising supporting each barrier underneath its entire length by a foundation and anchoring each barrier to the foundation underneath it.

6. A method as claimed in claim 5, the barriers including precast concrete traffic barriers.

7. A method as claimed in claim 5, the joint material being capable of accomodating further joint compression of at least about ¼-inch following the step of tensioning.

8. A method as claimed in claim 7, the joint material being capable of accomodating joint expansion of at least about ¼-inch following the step of tensioning.

9. A method for emplacing barriers, comprising the steps of stringing the barriers on a cable, placing between the barriers a joint material which is more pliable than that of the barriers, and tensioning to prestress the cable, the step of tensioning compacting the joint material to a desired expansion joint thickness, the joint material being compacted to a compressive stress of about 14 psi in the step of tensioning.

10. A method as claimed in claim 9, further comprising anchoring the barriers to a foundation.

11. A method as claimed in claim 9, the barriers including precast concrete traffic barriers.

12. A method as claimed in claim 9, the joint material being capable of accomodating further joint compression of at least about ¼-inch following the step of tensioning.

13. A method as claimed in claim 12, the joint material being capable of accomodating joint expansion of at least about ¼-inch following the step of tensioning.

14. A method for emplacing barriers, comprising the steps of stringing the barriers on a cable, placing between the barriers a joint material which is more pliable than that of the barriers, and tensioning to prestress the cable, the step of tensioning compacting the joint material to a desired expansion joint thickness.

15. A method as claimed in claim 14, further comprising anchoring the barriers to a foundation.

16. A method as claimed in claim 14, the barriers including precast concrete traffic barriers.

17. A method as claimed in claim 14, the joint material being capable of accomodating further joint compression of at least about ¼-inch following the step of tensioning.

18. A method as claimed in claim 17, the joint material being capable of accomodating joint expansion of at least about ¼-inch following the step of tensioning.

19. A method as claimed in claim 14, the joint having a thickness occupied completely by material which is more pliable than that of the barriers.

20. A barrier erection method, comprising the steps of stringing a cable through a first barrier, anchoring the cable at a back end of the first barrier, placing joint material at an ahead end of the first barrier, stringing the cable through a second barrier, tensioning the cable at an ahead end of the second barrier to cause a back end of the second barrier to compact the joint material between the back end of the second barrier and the ahead end of the first barrier, placing joint material at an ahead end of the second barrier, stringing the cable through a third barrier, tensioning the cable at an ahead end of the third barrier to cause a back end of the third barrier to compact the joint material between the back end of the third barrier and the ahead end of the second barrier.

21. A method as claimed in claim 20, further comprising anchoring the barriers to a foundation.

22. A method as claimed in claim 20, the barriers including precast concrete traffic barriers.

23. A method as claimed in claim 20, the joint material being capable of accomodating further joint compression of at least about ¼-inch following the step of tensioning.

24. A method as claimed in claim 23, the joint material being capable of accomodating joint expansion of at least about ¼-inch following the step of tensioning.

* * * * *